United States Patent [19]

Urfer et al.

[11] Patent Number: 4,488,981

[45] Date of Patent: Dec. 18, 1984

[54] LOWER ALKYL GLYCOSIDES TO REDUCE VISCOSITY IN AQUEOUS LIQUID DETERGENTS

[75] Inventors: Allen D. Urfer, Decatur; Leonard F. VanderBurgh, Bethany; Robert S. McDaniel, Jr., Decatur, all of Ill.

[73] Assignee: A. E. Staley Manufacturing Company, Decatur, Ill.

[21] Appl. No.: 529,435

[22] Filed: Sep. 6, 1983

[51] Int. Cl.[3] ..... C11D 1/66; C11D 1/831; C11D 3/22; C11D 17/08

[52] U.S. Cl. ..... 252/174.17; 252/174.21; 252/529; 252/532; 252/539; 252/540; 252/548; 252/551; 252/558; 252/559; 252/DIG. 1; 252/DIG. 14; 252/173; 536/18.6

[58] Field of Search ..... 252/153, 174.17, 174.21, 252/529, 532, 539, 540, 548, 551, 558, 559, DIG. 1, DIG. 14, 173; 536/18.6, 124

[56] References Cited

U.S. PATENT DOCUMENTS

| | | | |
|---|---|---|---|
| 3,219,656 | 11/1965 | Boettner | 252/174.17 |
| 3,547,828 | 12/1970 | Mansfield et al. | 252/351 |
| 3,721,633 | 3/1973 | Ranauto | 252/527 |
| 3,839,318 | 10/1974 | Mansfield | 536/18.6 |
| 3,892,681 | 7/1975 | Edwards et al. | 252/551 |
| 4,014,808 | 3/1977 | Herpers | 252/135 |
| 4,147,652 | 4/1979 | Kaniecki | 252/156 |
| 4,154,706 | 5/1979 | Kenkare | 252/547 |
| 4,230,592 | 10/1980 | Miller | 252/156 |
| 4,240,921 | 12/1980 | Kaniecki | 252/156 |
| 4,393,203 | 7/1983 | Mao | 536/124 |
| 4,396,520 | 8/1983 | Payne | 252/89.1 |

OTHER PUBLICATIONS

*Soap/Cosmetics/Chemical Specialties,* Nov., 1979, pp. 33 et seq., "The Formulation of Non-Built Heavy Duty Liquids", Part I(A): The Effect of Hydrotropes on Physical Properties (Viscosity), Matson and Berretz.

*Soap/Cosmetics/Chemical Specialties,* Dec., 1979, pp. 41 et seq., "The Formulation of Non-Built Heavy-Duty Liquids", Part I(B): The Effect of Hydrotropes on Physical Properties (Solubility), Matson and Berretz.

*Primary Examiner*—Dennis L. Albrecht

*Attorney, Agent, or Firm*—Philip L. Bateman; James B. Guffey; Forrest L. Collins

[57] ABSTRACT

Lower alkyl glycosides are added to aqueous liquid detergents to reduce their viscosity and to prevent phase separation. The glycosides are represented by the formula R—O—$(G)_n$ where "R" is a lower alkyl group having 2 to 6 carbon atoms, "O" is an oxygen atom, "G" is a saccharide unit, and "n" is a number from 1 to 10. The glycosides comprise about 1 to 10 weight percent of the detergents.

18 Claims, No Drawings

LOWER ALKYL GLYCOSIDES TO REDUCE VISCOSITY IN AQUEOUS LIQUID DETERGENTS

FIELD OF THE INVENTION

This invention relates to aqueous liquid detergents. More particularly, one embodiment of this invention relates to the use of lower alkyl glycosides to reduce the viscosity of, and to prevent phase separation in, aqueous liquid detergents. Another embodiment of this invention relates to single-phase, low-viscosity aqueous liquid detergent compositions comprising lower alkyl glycosides.

BACKGROUND OF THE INVENTION

A. Detergents

Detergents are substances used to remove soil from materials with water. Since detergents are used under such different conditions, e.g., type of soil, material to be cleaned, water temperature, etc., it is not surprising that many different types of detergents are available. One class of detergents are the bar soaps, liquid soaps, and liquid shampoos used for personal cleaning. A second class of detergents are the "light-duty" liquids and powders used for dishwashing and miscellaneous household cleaning. A third class of detergents are the "heavy duty" liquids and powders primarily used for cleaning clothes in washing machines.

All detergents contain at least one surfactant. A surfactant is a substance whose molecules contain both hydrophilic and oleophilic groups. The surfactants are primarily responsible for the soil-removing properties of the detergent, although many other components of the detergent augment the surfactants. Surfactants are routinely classified according to their electrostatic charge: the nonionics possess no net electrostatic charge, the anionics possess a negative charge, the cationics possess a positive charge, and the atmospherics possess both positive and negative charges.

Most detergents, contain many other substances in addition to the surfactants. Some detergents contain builders which aid the soil-removing properties of the surfactants in several ways. In particular, builders help prevent the formation of insoluble soap deposits, aid in soap suspension, and help prevent the precipitation of certain calcium and magnesium salts. Some detergents employ hydrotropes to reduce their viscosity and to prevent phase separation. Fillers are used in some detergents to control density and improve flow properties. Many heavy-duty detergents contain anti-redeposition agents to help prevent redeposition of soil on the clothes. Other ingredients commonly found in detergents are perfumes, corrosion inhibitors, pH adjusters or buffers, dyes or colorings, optical brighteners, foam control agents, bleaches, opacifiers, and stabilizers.

Most types of detergents are sold both as powders and as liquids. Although some powders are prepared by mixing together dry ingredients, the vast majority of powders are prepared by drying an aqueous slurry of ingredients. The popularity of the liquids continues to increase, primarily because of their convenience to the consumer, but also because of the savings in eliminating the drying step. However, the powdered heavy-duty detergents still outsell the liquid heavy-duty detergents because there continues to be difficulty in formulating a heavy-duty liquid which cleans as well as a powder. The powders generally contain rather large amounts of builders to improve the performance of the surfactants.

Unfortunately, the most effective builders have relatively low water solubilities and are used, if at all, in relatively small amounts in the liquids. To compensate for the absence or low level of builder, detergent manufacturers have tried to increase the level of surfactants in the liquids. However, the level of surfactants is limited by viscosity and problems of phase separation. Many detergent manufacturers have attempted to improve the physical properties of their heavy-duty liquids by including hydrotropes in their formulations.

B. Hydrotropes in Detergents

As mentioned above, the term hydrotrope is commonly used in the detergent industry to refer to a substance which reduces viscosity and prevents phase separation. It is widely believed that hydrotropes cause this effect by coupling dissimilar molecules and by increasing solubilities of other components. Hydrotropes need not be surface active themselves and do not need to form micelles to effect their action. The effect of hydrotropes on the physical properties of aqueous liquid detergents is discussed more fully in Matson, T. P. and Berretz, M., "The Formulation of Non-Built Heavy-Duty Liquid: The Effect of Hydrotropes on Physical Properties" *Soap/Cosmetics/Chemical Specialties,* pp. 33 et seq. (Nov., 1979) and pp. 41 et seq. (Dec., 1979).

The most commonly used hydrotropes in detergents are ethanol and sodium xylene sulfonate. Ethanol is very effective in a wide range of detergent formulations. However, it is not without disadvantages. For example, its odor (especially of the non-food grades) is difficult to mask with fragrances, it is an explosion hazard to the manufacturer, it is very volatile and requires the consumer to keep the detergent containers sealed to prevent evaporation, and the food-grades are relatively expensive and require special permits, licenses, etc. Sodium xylene sulfonate is relatively inexpensive and is compatible with a wide range of detergent ingredients, but becomes relatively ineffective at higher surfactant levels.

Monoethanolamine, diethanolamine, and triethanolamine are occasionally used in liquid detergents to reduce viscosity, but they are not true hydrotropes since they do not couple and, therefore, do not prevent phase separation. A number of organic and inorganic salts are used as hydrotropes in detergent compositions, but they tend to be very selective in the compositions in which they function.

C. Glycosides in Detergents

It is well-known that certain alkyl glycosides are surface active and are useful as nonionic surfactants in detergent compositions. The alkyl glycoside exhibiting the greatest surface activity have relatively long-chain alkyl groups. These alkyl groups generally contain about 8 to 25 carbon atoms and preferably about 10 to 14 carbon atoms. See, for example, Ranauto, U.S. Pat. No. 3,721,633, at col. 2, lines 17 through 36.

Long-chain alkyl glycosides are commonly prepared from saccharides and long-chain alcohols. However, unsubstituted saccharides, such as glucose, and long-chain alcohols are insoluble and do not react together easily. Therefore, it is common to first convert the saccharide to an intermediate, lower alkyl glycoside which is then reacted with the long-chain alcohol. Butyl glycoside is often employed as the intermediate. Since the lower alkyl glycosides are not as surface active as their long-chain counterparts, it is generally desired to reduce their concentration in the final product as much as possible.

Mansfield, U.S. Pat. No. 3,547,828, discloses a glycoside mixture which is useful as a textile detergent. The mixture has two and, optionally, three components. The first component is a long-chain ($C_8$ to $C_{32}$) alkyl oligosaccharide. The second component is a long-chain ($C_{11}$ to $C_{32}$) alkyl monoglucoside. The third, and optional, component is a long-chain ($C_{11}$ to $C_{32}$) alcohol. This mixture is prepared by reacting a short-chain monoglucoside, preferably butyl glucoside, with the long-chain alcohol. At col. 3, lines 22 through 36, Mansfield states that the mixture has a lower viscosity and melting point if some butyl oligosaccharide is included. There is no teaching or suggestion of the effect the butyl oligosaccharides might have in an aqueous liquid detergent. At col. 4, lines 27 through 33, Mansfield states that acetone-insoluble long-chain alkyl oligosaccharides are useful as hydrotropes for long-chain alkyl glucosides and other surface active agents. This statement neither teaches nor suggests the effect of lower alkyl glycosides in aqueous liquid detergents.

SUMMARY OF THE INVENTION

The general object of this invention is to provide an improved hydrotrope for reducing the viscosity of, and for preventing phase separation in, aqueous liquid detergents. The more particular objects are to provide a hydrotrope which is inexpensive, non-toxic, non-volatile, and effective in many detergent compositions.

We have discovered that lower alkyl glycosides represented by the formula R—O—$(G)_n$ where "R" is a lower alkyl group having 2 to 6 carbon atoms, "O" is an oxygen atom, "G" is a saccharide unit, and "n" is a number from 1 to 10 are effective hydrotropes when comprising about 1 to 10 weight percent of an aqueous liquid detergent. The glycosides are added to the detergent to reduce its viscosity and to prevent phase separation. The resulting detergents are single-phase and have a viscosity at 25° C. of about 70 to 350 cps.

DETAILED DESCRIPTION OF THE INVENTION

A. The Lower Alkyl Glycosides

The lower alkyl glycosides employed in this invention are represented by the formula R—O—$(G)_n$ where "R" is a lower alkyl group having 2 to 6 carbon atoms, "O" is an oxygen atom, "G" is a saccharide unit, and "n" is a number from 1 to 10.

The lower alkyl group having 2 to 6 carbon atoms, "R", may be a straight or branched chain and may be saturated or unsaturated. Glycosides with alkyl groups of 1 carbon atom, i.e. methyl glycoside, and with alkyl groups having more than 6 carbon atoms are not as effective in reducing the viscosity of the aqueous liquid detergents. Preferably, the lower alkyl group has 2 to 4 carbons and is a saturated, straight chain. In other words, the preferred groups are ethyl, propyl, and butyl.

The saccharide unit, "G", may be either an aldose (a polyhydroxy aldehyde) or a ketose (a polyhydroxy ketone) and may contain from 3 to 6 or more carbon atoms (trioses, tetroses, pentoses, hexoses, etc.). Illustrative aldose units include apiose, arabinose, galactose, glucose, lyxose, mannose, gallose, altrose, idose, ribose, talose, xylose, etc. and the derivatives thereof. Illustrative ketose units include fructose, etc. and the derivatives thereof. The saccharide unit is preferably a 5 or 6 carbon aldose unit and is most preferably a glucose unit.

The number "n" represents the number of saccharide units linked together in a single glycoside molecule. This number is used synonomously with the term "degree of polpymerization" or its abbreviation "D.P.". When a glycoside has an "n" value of 1 and a "D.P." of 1, it is commonly called a substituted monosaccharide. Similarly, when both "n" and "D.P." are 2 or greater, the glycoside is commonly called a substituted polysaccharide or oligosaccharide. Glycosides having a "n" value of greater than about 10 are less useful as hydrotropes because of their decreased affinity toward the polar components in the liquid detergent. The glycosides preferably have a "n" value of 1 to 6 and most preferably have a "n" value of 2 to 4.

The alkyl group, "R", is linked to the saccharide by an oxygen atom, "O". The linkage generally occurs at the number one carbon of the saccharide unit at the end of the chain.

Lower alkyl glycosides are commercially available and are commonly prepared by reacting a saccharide with a lower alcohol in the presence of an acid catalyst. See, for example, Mansfield, U.S. Pat. No. 3,547,828 at col. 2, lines 16 through 39.

B. Suitable Aqueous Liquid Detergents

The lower alkyl glycosides of this invention are advantageously added to aqueous liquid detergents when a reduction in viscosity, or a prevention of phase separation, is desired. The lower alkyl glycosides are especially useful in detergents which are marketed and used by the consumer in liquid form. However, these glycosides are also useful in detergents which are formulated as aqueous liquids but are then dried to powders before marketing and use by the consumer. The glycosides are useful in liquid shampoos and soaps and in light-duty liquids, but their greatest utility is probably in heavy-duty laundry detergents where viscosity and phase separation are often problems.

As previously mentioned, aqueous liquid detergents are formulated with at least one surfactant and the choice of surfactant(s) depends on the intended usage of the detergent and on the other components in the detergent. The most widely used type of surfactant in detergents are the anionics. The more common anionics include the sulfonates, the sulfates, the carboxylates, and the phosphates. The preferred anionics for use in this invention are the sulfonates and the sulfates. The second most widely used surfactants are the nonionics. The more common nonionics include the ethoxylates, such as ethoxylated alcohols, ethoxylated alkylphenols, ethoxylated carboxylic esters, and ethoxylated carboxylic amides. The preferred nonionics are the ethoxylated alcohols. Cationic surfactants, such as the amides and the quaternary ammonium salts, and amphoteric surfactants are used less frequently in detergents. In fact, the anionics and the nonionics generally comprise greater than about 90 weight percent of the surfactants in aqueous liquid detergents. A more complete listing of surfactants commonly used in detergents is found in Edwards, U.S. Pat. No. 3,892,681.

The detergent component which probably has the greatest effect on the surfactants are the builders. The most effective, and still the most common, builders are the phosphates, such as sodium tripolyphosphate (STPP), tetrasodium pyrophosphate (TSPP), tetrapotassium pyrophosphate (TKPP), and trisodium phosphate (TSP). The use of phosphates in detergents is banned in many parts of the U.S.A. for environmental reasons. Other types of builders include the citrates, the zeolites, the silicates, and the polycarboxylate salts, such as salts of nitrilotriacetic acid (NTA).

Other components which may or may not be present in the aqueous liquid detergents of this invention include hydrotropess (other than lower alkyl glycosides), fillers, anti-redeposition agents, perfumes, corrosion inhibitors, pH adjusters or buffers, dyes or colorings, optical brighteners, foam control agents, bleaches, opacifiers, and stabilizers.

The composition of detergents within a given class vary widely, but some generalization can be made. Liquid shampoos and soaps for personal cleaning typically contain about 10 to 40 weight percent surfactant; little, if any, builder; and a major amount of water. Similarly, typical light-duty liquids contain about 10 to 40 weight percent surfactant; little, if any, builder; and a major amount of water. Heavy-duty powders typically contain about 10 to 30 weight percent surfactant, about 30 to 60 weight percent builder, and small amounts of water. Built heavy-duty liquids typically contain about 10 to 30 weight percent surfactant, about 5 to 25 weight percent builder, and a major amount of water. Unbuilt heavy-duty liquids typically contain about 25 to 60 weight percent surfactant; little, if any, builder; and about 30 to 70 weight percent water.

Many detergents, especially the heavy-duty detergents, are formulated with both anionic and nonionic surfactants. The weight ratio of nonionic to anionic varies from about 10:1 to 1:10. In unbuilt heavy-duty liquids, this ratio is advantageously about 1:1 to 5:1.

C. Methods and Amounts of Addition

The lower alkyl glycosides can be added to an aqueous liquid detergent at any point during or after its preparation. For convenience, the glycosides are preferably added at the same time the other ingredients are mixed together to form the detergent. As previously mentioned, in the preparation of powders, the glycosides are added to the liquid slurry before drying.

The glycosides are generally added in an amount sufficient to prevent phase separation and to reduce the viscosity of the aqueous liquid detergent to about 70 to 350 cps. at 25° C. The glycosides are generally added in an amount such that they comprise about 1 to 10 weight percent of the aqueous liquid detergent. The amount used in a given detergent depends, of couse, on the viscosity reduction desired and on how severe the problem of phase separation is. Concentrations above about 10 weight percent are generally undesirable because it necessitates a reduction in other active components, e.g., the surfactants, in the detergent. The lower alkyl glycosides preferably comprise about 2 to 6 weight percent of the aqueous liquid detergent.

D. Examples

The following Examples are illustrative only.

EXAMPLE 1

This Example illustrates the lower alkyl monoglucosides (D.P. = 1) reduce the viscosity of an aqueous liquid detergent.

Eight aqueous liquid detergents, differing only in the additive employed, were prepared by a conventional blending process. The detergents had the following compositions:

| Ingredient | Weight Percent |
|---|---|
| Nonionic surfactant | 37.5 |
| Anionic surfactant | 12.5 |
| Triethanolamine (TEA) | 5.0 |
| Potassium chloride | 1.0 |
| Additive | 6.0 |
| Water | 38.0 |
| | 100.0 |

The nonionic surfactant was a $C_{12}$ to $C_{15}$ linear primary alcohol ethoxylate containing 7 moles ethylene oxide per mole of primary alcohol, marketed under the trademark Neodol 25-7 ® by Shell Chemical Company, One Shell Plaza, Houston, Tex. 77002. The anionic surfactant was a sodium linear alkylate sulfonate slurry (58 weight percent active surfactant, marketed under the trademark Biosoft D-62 ® by Stepan Chemical Company, Edens and Winnetka Roads, Northfield, Ill. 60093. The viscosity of the detergents was measured with a Wells-Brookfield Microviscometer Model RVT-C/P using a 1.565° cone.

Table I illustrates the effect of the choice of additive on the viscosity of the detergent.

TABLE I

Effect of Additive on Viscosity

| Additive | Viscosity of Detergent (cps at 25° C.) |
|---|---|
| Water (control) | 2054 |
| Ethyl alcohol | 102 |
| Ethyl monoglucoside | 992 |
| Propyl monoglucoside | 751 |
| Butyl monoglucoside | 157 |
| Amyl monoglucoside | 257 |
| Hexyl monoglucoside | 178 |
| Octyl monoglucoside | 1750 |

The data show that the lower alkyl monoglucosides having 2 to 6 carbon atoms in the alkyl group significantly reduce the viscosity of the aqueous liquid detergent.

EXAMPLE II

This Example illustrates that lower alkyl monoglucosides (D.P. = 1) reduce the viscosity of other aqueous liquid detergents.

The procedure of Example I was repeated except that the anionic surfactant employed was a $C_{12}$ to $C_{15}$ linear primary alcohol ethoxylate sodium salt (60 weight percent active surfactant), marketed under the trademark Neodol 25-3S ® by Shell Chemical Company, One Shell Plaza, Houston, Tex. 77002.

Table II illustrates the effect of the choice of additive on the viscosity of the detergent.

TABLE II

Effect of Additive on Viscosity

| Additive | Viscosity of Detergent (cps at 25° C.) |
|---|---|
| Water (control) | 455 |
| Ethyl alcohol | 121 |
| Ethyl monoglucoside | 271 |
| Propyl monoglucoside | 270 |
| Butyl monoglucoside | 293 |
| Amyl monoglucoside | 323 |
| Hexyl monoglucoside | 300 |

TABLE II-continued

| Effect of Additive on Viscosity | |
|---|---|
| Additive | Viscosity of Detergent (cps at 25° C.) |
| Octyl monoglucoside | 373 |

The data again show that lower alkyl monoglucosides having 2 to 6 carbon atoms in the alkyl group significantly reduce the viscosity of aqueous liquid detergents.

EXAMPLE III

This Example illustrates that butyl polyglucosides (D.P.>1) reduce the viscosity of, and prevent phase separation in, an aqueous liquid detergent.

The procedure of Example I was repeated except that the anionic surfactant employed was a straight-chain dodecyl benzene sodium sulfonate slurry (58 weight percent active surfactant), marketed under the trademark Conoco C-560 by Conoco Chemicals, Continental Oil Company, 5 Greenway Plaza East, P.O. Box 2197, Houston, Tex. 77001.

Table III illustrates the effect of the choice of additive on the visually perceivable properties of the detergent.

TABLE III

| Effect of Additive on Properties | | |
|---|---|---|
| Additive | D. P. of Additive | Visually Perceivable Properties of Detergent at 25° C. |
| Water (control) | N/A | Highly viscous, unpourable mass |
| Ethyl alcohol | N/A | Highly fluid, easily pourable single phase |
| Methyl polyglucoside | approx. 2 | Highly viscous, difficult to pour |
| Butyl polyglucoside | 1.8 | Highly fluid, easily pourable single phase |
| Butyl polyglucoside | 6.3 | Fluid, easily pourable single phase |
| Dodecyl polyglucoside | 5.6 | Highly viscous, unpourable mass |

The data show that butyl polyglucosides reduce the viscosity of, and prevent phase separation in, the aqueous liquid detergent.

We claim:

1. A process for reducing the viscosity of, and for preventing phase separation in, an aqueous liquid detergent having an initial viscosity of at least about 350 cps which comprises adding to an aqueous liquid detergent about 1 to 10 weight percent of a lower alkyl glycoside represented by the formula R—O—$(G)_n$ where "R" is a lower alkyl group having 2 to 5 carbon atoms, "O" is an oxygen atom, "G" is a saccharide unit, and "n" is a number from 1 to 10.

2. The process of claim 1 wherein "R" is a lower alkyl group having 2 to 4 carbon atoms, "G" is an aldose unit, and "n" is a number from 1 to 6.

3. The process of claim 2 wherein about 2 to 6 weight percent of the lower alkyl glycoside is added to the liquid detergent.

4. The process of claim 3 wherein greater than about 90 weight percent of the surfactants in the liquid detergent are anionic or nonionic.

5. The process of claim 4 wherein the liquid detergent comprises a builder and further comprises about 10 to 30 weight percent surfactants.

6. The process of claim 5 wherein "R" is an ethyl, propyl, or butyl group, "G" is a glucose unit, and "n" is a number from about 2 to 4.

7. The process of claim 4 wherein the liquid detergent is substantially free from builders and comprises about 25 to 60 weight percent surfactants.

8. The process of claim 7 wherein the weight ratio of nonionic surfactant to anionic surfactant in the liquid detergent is about 1:1 to about 5:1.

9. The process of claim 8 wherein "R" is an ethyl, propyl, or butyl group, "G" is a glucose unit, and "n" is a number from about 2 to 4.

10. A single-phase aqueous liquid detergent composition having a viscosity at 25° C. of about 70 to 350 cps. which comprises about 1 to 10 weight percent of a lower alkyl glycoside represented by the formula R—O—$(G)_n$ where "R" is a lower alkyl group having 2 to 5 carbon atoms, "O" is an oxygen atom, "G" is a saccharide unit, and "n" is a number from 1 to 10 said detergent having a viscosity of at least about 350 cps in the absence of the glycoside.

11. The composition of claim 10 wherein "R" is a lower alkyl group having 2 to 4 carbon atoms, "G" is an aldose unit, and "n" is a number from 1 to 6.

12. The composition of claim 11 wherein the liquid detergent comprises about 2 to 6 weight percent of the lower alkyl glycoside.

13. The composition of claim 12 wherein greater than 90 weight percent of the surfactants in the liquid detergent are anionic or nonionic.

14. The composition of claim 13 wherein the liquid detergent comprises a builder and further comprises about 10 to 30 weight percent surfactants.

15. The composition of claim 14 wherein "R" is an ethyl, propyl, or butyl group, "G" is a glucose unit, and "n" is a number from about 2 to 4.

16. The composition of claim 13 wherein the liquid detergent is substantially free from builders and comprises about 25 to 60 weight percent surfactants.

17. The composition of claim 16 wherein the weight ratio of nonionic surfactant to anionic surfactant in the liquid detergent is about 1:1 to about 5:1.

18. The composition of claim 17 wherein "R" is an ethyl, propyl, or butyl group, "G" is a glucose unit, and "n" is a number from about 2 to 4.

* * * * *